US011393370B2

(12) United States Patent
Ma et al.

(10) Patent No.: US 11,393,370 B2
(45) Date of Patent: Jul. 19, 2022

(54) DISPLAY MODULE, DISPLAY DEVICE AND DRIVING METHOD OF THE DISPLAY MODULE

(71) Applicant: Wuhan Tianma Micro-Electronics Co., Ltd., Wuhan (CN)

(72) Inventors: Weiwei Ma, Wuhan (CN); Zhihua Yu, Wuhan (CN); Jun Li, Wuhan (CN)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

(21) Appl. No.: 17/146,195

(22) Filed: Jan. 11, 2021

(65) Prior Publication Data

US 2021/0134198 A1 May 6, 2021

(30) Foreign Application Priority Data

Nov. 2, 2020 (CN) ..... 202011204831.2

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 2310/0275* (2013.01); *G09G 2330/12* (2013.01)

(58) Field of Classification Search
CPC ..... G06F 1/1652; G06F 3/04164; H01L 2251/5338; H01L 51/0097; G09G 3/006; G09G 3/20; G09G 3/36
See application file for complete search history.

(56) References Cited

U.S. PATENT DOCUMENTS

2017/0331371 A1* 11/2017 Parto ..... H02M 3/156
2020/0176699 A1* 6/2020 Lee ..... H01L 27/3276

FOREIGN PATENT DOCUMENTS

CN 111028777 A 4/2020

* cited by examiner

*Primary Examiner* — Gerald Johnson
(74) *Attorney, Agent, or Firm* — Alston & Bird LLP

(57) ABSTRACT

Provided are a display module, a display device and a driving method of the display module. The display module includes: a display panel, where the display panel includes a display area and a non-display area, a substrate, and a plurality of sub-pixels and a power line disposed on the substrate; a flexible circuit board, where the flexible circuit board is bound to the substrate in the non-display area and includes a power bus electrically connected to the power line; a driver chip including at least one detection pin and at least one control pin; and a voltage detection circuit including a first detection terminal, a second detection terminal, an output terminal and a control terminal.

18 Claims, 11 Drawing Sheets

DISPLAY MODULE, DISPLAY DEVICE AND DRIVING METHOD OF THE DISPLAY MODULE

CROSS-REFERENCE TO RELATED APPLICATIONS

This application claims priority to Chinese Patent Application No. CN202011204831.2 filed at CNIPA on Nov. 2, 2020, the disclosure of which is incorporated herein by reference in its entirety.

TECHNICAL FIELD

The present disclosure relates to the field of display techniques and, in particular, to a display module, a display device and a driving method of the display module.

BACKGROUND

During displaying, a power chip transmits a power signal to a power line through a power bus in the display device. The power bus and the power line in the display device are connected through an anisotropic conductive paste. The anisotropic conductive paste has a resistance, and the connections between the power chip and the power bus and the like lead to the occurrence of another resistance in a circuit next to the power bus. In order to improve a display effect, the voltage drop caused by the two types of resistances is partially compensated for by some circuits. However, in the related art, it is difficult to obtain both effect of excellent full-picture display and also excellent local-picture display.

SUMMARY

A display module, a display device and a driving method of the display module are provided in the present disclosure so as to obtain both excellent full-picture display effect and excellent local-picture display effect.

In a first aspect, a display module is provided in an embodiment of the present disclosure and includes a display panel, a flexible circuit board, a driver chip and a voltage detection circuit.

The display panel includes a display area and a non-display area and further includes a substrate and a plurality of sub-pixels and a power line which are disposed on the substrate.

The flexible circuit board is bound to the non-display area of the substrate and includes a power bus electrically connected to the power line.

The driver chip includes at least one detection pin and at least one control pin.

The voltage detection circuit includes a first detection terminal, a second detection terminal, an output terminal and a control terminal, where the first detection terminal is electrically connected to the power line, the second detection terminal is electrically connected to the power bus, the output terminal is electrically connected to one of the at least one detection pin, and the control terminal is electrically connected to one of the at least one control pin.

In a second aspect, a display device is provided in an embodiment of the present disclosure and includes the display module described in the first aspect.

In a third aspect, a driving method based on the display module described in the first aspect is provided in an embodiment of the present disclosure and includes the steps described below.

In a case where a display picture requires a low voltage drop, the driver chip controls turn-on to be performed between the output terminal of the voltage detection circuit and the first detection terminal of the voltage detection circuit so as to detect a current voltage value of the power line and compensate for a difference, of a data voltage, between the current voltage value of the power line and a preset value.

In a case where a display picture requires a high peak brightness, the driver chip controls turn-on to be performed between the output terminal of the voltage detection circuit and the second detection terminal of the voltage detection circuit so as to detect a current voltage value of the power bus and compensate for a difference, of a data voltage, between the current voltage value of the power bus and a preset value.

In the display module provided in the embodiment of the present disclosure, the voltage detection circuit includes the first detection terminal, the second detection terminal, the output terminal and the control terminal. The first detection terminal is electrically connected to the power line, the second detection terminal is electrically connected to the power bus, the output terminal is electrically connected to a detection pin, and the control terminal is electrically connected to a control pin. When the control terminal controls turn-on to be performed between the output terminal and the first detection terminal, a detection pin of the driver chip acquires the voltage drop across the first resistance and across the second resistance, and the voltage drop across the first resistance and across the second resistance is compensated for, so that the display module obtains an excellent full-picture display effect. When the control terminal controls turn-on to be performed between the output terminal and the second detection terminal, a detection pin of the driver chip acquires the voltage drop across the second resistance, and the voltage drop across the second resistance is compensated for, so that the display module obtains an excellent local-picture display effect.

DETAILED DESCRIPTION

Figure 1:
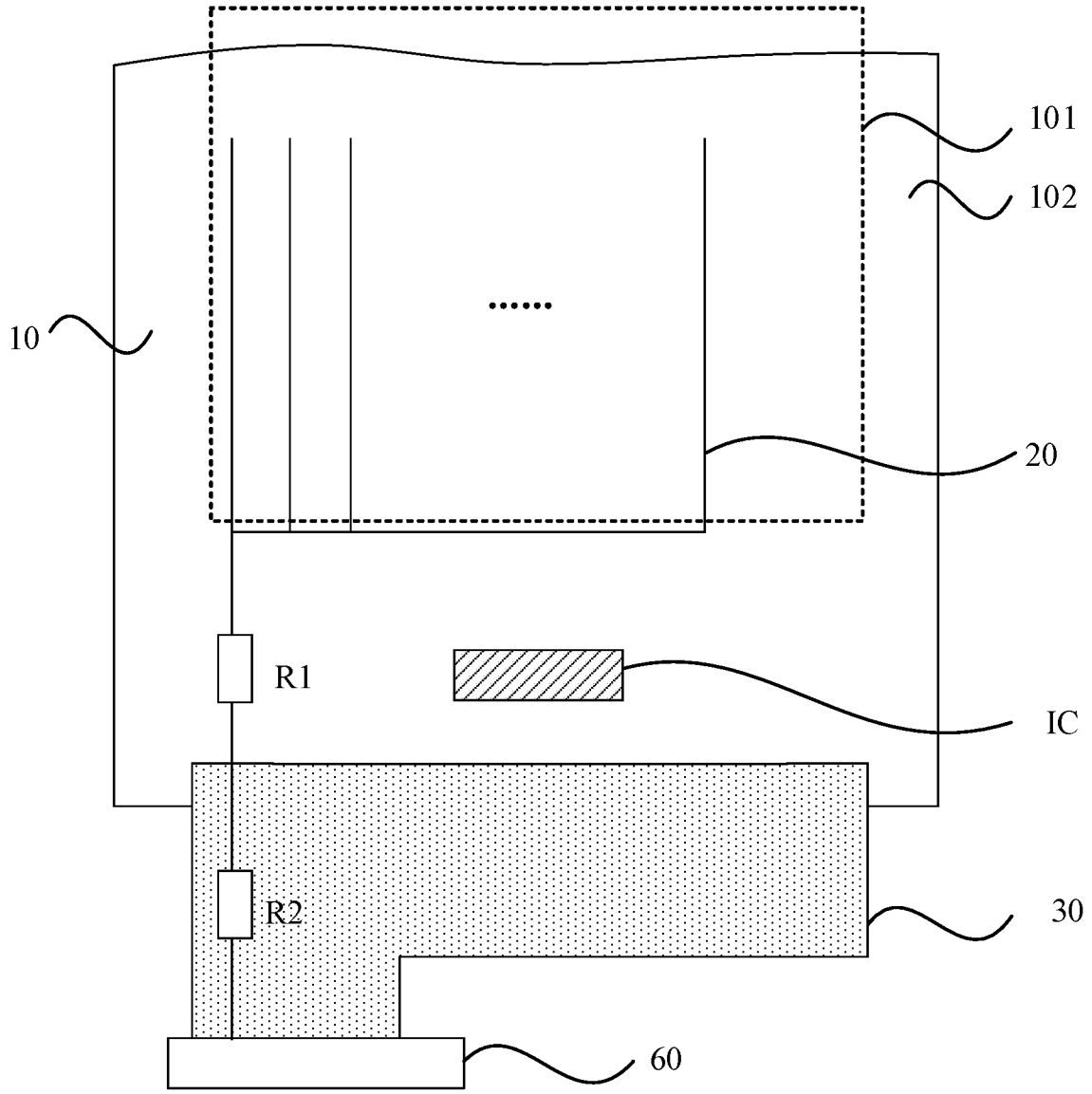
FIG. 1 is a schematic diagram of an equivalent resistance in a display module in the related art.

Hereinafter the present disclosure will be further described in detail in conjunction with drawings and embodiments. It is to be understood that the embodiments set forth herein are intended to explain the present disclosure and not to limit the present disclosure. Additionally, it is to be noted that for ease of description, merely part, not all, of the structures related to the present disclosure are illustrated in the drawings.

FIG. 1 is a schematic diagram of an equivalent resistance in a display module in the related art. Referring to FIG. 1, during display, a power chip 60 transmits a power signal to a power line through a power bus. The power bus and the power line are connected through an anisotropic conductive paste (not shown in FIG. 1). The anisotropic conductive paste has a first resistance R1 in the power line, and the connections between the power chip 60 and the power bus and the like lead to the existence of a second resistance R2 in a circuit in front of the power bus. Due to the presence of the first resistance R1 and the second resistance R2, the voltage PVDD transmitted to a power line 20 in a display area 101 satisfies formula (1):

$$PVDD=PVDD_{power}-I\times R_1-I\times R_2 \quad (1).$$

$PVDD_{power}$ denotes the output voltage of the power chip 60, and I denotes the current in the power line.

The data voltage $V_{data}$ output by a driver chip IC satisfies formula (2):

$$V_{data} = VGMP-(VGMP-VGSP)\times\frac{\text{Gamma}}{4096}. \quad (2)$$

Gamma denotes a gamma voltage. The gamma parameter represented by the gamma voltage indicates the nonlinear relationship between the brightness of the display module and an input voltage and is a correction parameter for the display module to adapt to the perception requirements of human eyes. VGMP denotes a first reference voltage for generating the gamma voltage, and VGSP denotes a second reference voltage for generating the gamma voltage.

The emitting brightness L of the display module satisfies formula (3):

$$L=K\times(PVDD-V_{data})^2 \quad (3).$$

K is a scale factor. Formula (4) can be obtained by integrating formula (1), formula (2) and formula (3):

$$L = K\times\left(PVDD_{power}-I\times(R_1+R_2)-VGMP+(VGMP-VGSP)\times\frac{\text{Gamma}}{4096}\right)^2. \quad (4)$$

As can be seen from formula (4), when at least one of the first resistance R1 or the second resistance R2 changes, the display brightness of a picture will change too, and an excellent full-picture display cannot be achieved. Therefore, the voltage drop jointly caused by the first resistance R1 and the second resistance R2 needs to be compensated for. On the other hand, the larger the value of R1 plus R2, the more significant the effect of brightness increases, that is, the higher the high peak brightness. Therefore, it is necessary to keep at least one of the first resistance R1 or the second resistance R2 not to be compensated to improve the high peak brightness. In order for the display panel to adapt to different driver chips 60, the second resistance R2 needs to be compensated, so that the first resistance R1 can be kept not to be compensated so as to obtain an excellent local-picture display effect. In other words, the first compensation method is to compensate for the voltage drop jointly caused by the first resistance R1 and the second resistance R2. At this time, the voltage drop of the power signal transmitted to the display area of the display panel is small, conducive to full-picture display, that is, the brightness difference when different pictures are displayed under a same drive voltage is small. However, the effect of local-picture display is not good under the first compensation method. During local-picture display, such as the local-picture display of a starry sky, local (such as stars with large local brightness) brightness is large and the contrast is required to be high. The second compensation method is to compensate for the voltage drop caused by R2 and not to compensate for the voltage drop caused by R1. The display picture has high peak brightness, conducive to local-picture display. However, the effect of full-picture display is not good under the second compensation method.

Figure 2:
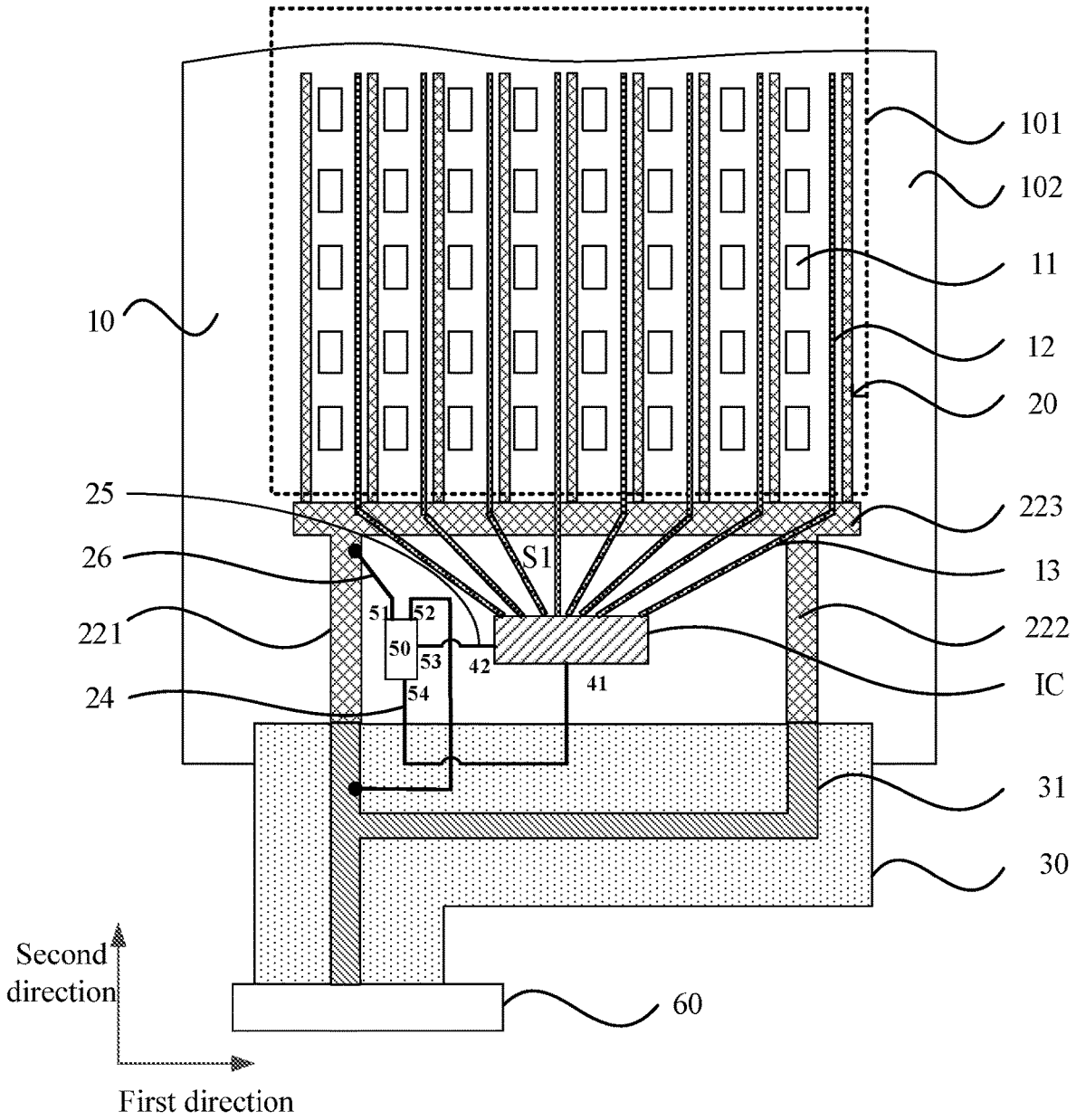
FIG. 2 is a top view of a display module according to an embodiment of the present disclosure.

FIG. 2 is a top view of a display module according to an embodiment of the present disclosure. Referring to FIG. 2, the display module includes a display panel, a flexible circuit board 30 and a driver chip IC. The display panel may, for example, be a liquid crystal display panel, an organic light-emitting display panel or another panel for displaying pictures. The display panel includes a display area 101 and a non-display area 102 and further includes a substrate 10 and a plurality of sub-pixels 11 and a power line 20 which are disposed on the substrate 10. The power line 20 is used for supplying a power signal to the plurality of sub-pixels 11. The flexible circuit board 30 is bound to the substrate 10 in the non-display area 102. The flexible circuit board 30 includes a power bus 31 electrically connected to the power line 20. The power signal is transmitted to the power line 20 through the power bus 31. The driver chip IC includes at least one detection pin 41 and at least one control pin 42. The display module further includes a voltage detection circuit 50 including a first detection terminal 51, a second detection terminal 52, an output terminal 54 and a control terminal 53, where the first detection terminal 51 is electrically connected to the power line 20, the second detection terminal 52 is electrically connected to the power bus 31, the output terminal 54 is electrically connected to the detection pin 41, and the control terminal 53 is electrically connected to the control pin 42. The control terminal 53 is used for controlling the output terminal 54 to be electrically connected to the first detection terminal 51 or to the second detection terminal 52.

When a display picture requires a low voltage drop, the control terminal 53 controls the output terminal 54 to be electrically connected to the first detection terminal 51, the detection pin 41 is electrically connected to the power line 20, and the driver chip IC detects a current voltage value of the power line 20. The difference between the current voltage value of the power line 20 and a preset value is a first compensation voltage $V_{AVC1}$, and the first compensation voltage $V_{AVC1}$ satisfies formula (5):

$$V_{avc1}=I\times R_1+I\times R_2 \quad (5).$$

The difference of a data voltage between the current voltage value of the power line 20 and the preset value is compensated for, and the data voltage $V_{data}$ satisfies formula (6):

$$V_{data} = (VGMP - V_{avc1}) - ((VGMP - V_{avc1}) - (VGSP - V_{avc1})) \times \frac{\text{Gamma}}{4096}. \quad (6)$$

Formula (7) can be obtained by integrating formula (1), formula (3) and formula (6):

$$L = K \times \left(PVDD_{power} - VGMP + (VGMP - VGSP) \times \frac{\text{Gamma}}{4096}\right)^2. \quad (7)$$

As can be seen from formula (7), after the first compensation voltage $V_{AVC1}$ of the data voltage is compensated for, the emitting brightness L of the display module does not depend on the first resistance R1 and the second resistance R2 and the voltage drop jointly caused by the resistance R1 and the second resistance R2 is compensated for in the data signal output by the driver chip IC. This is equivalent to that neither the first resistance R1 nor the second resistance R2 occurs and that no voltage drop across the first resistance R1 or across the second resistance R2 occurs, satisfying the requirement of a low drop of the display picture and obtaining an excellent full-picture display effect.

When a display picture requires a high peak brightness, the control terminal 53 controls the output terminal 54 to be electrically connected to the second detection terminal 52, the detection pin 41 is electrically connected to the power bus 31, and the driver chip IC detects a current voltage value of the power bus 31. The difference between the current voltage value of the power bus 31 and a preset value is a second compensation voltage $V_{AVC2}$, and the second compensation voltage $V_{AVC2}$ satisfies formula (8):

$$V_{avc2} = I \times R_2 \quad (8).$$

The difference, of a data voltage, between the current voltage value of the power bus 31 and the preset value is compensated for, and a data voltage $V_{data}$ satisfies formula (9):

$$V_{data} = (VGMP - V_{avc2}) - ((VGMP - V_{avc2}) - (VGSP - V_{avc2})) \times \frac{\text{Gamma}}{4096}. \quad (9)$$

Formula (10) can be obtained by integrating formula (1), formula (3) and formula (9):

$$L = K \times \left(\begin{array}{c} PVDD_{power} - I \times R_1 - VGMP + \\ (VGMP - VGSP) \times \frac{\text{Gamma}}{4096} \end{array}\right)^2. \quad (10)$$

As can be seen from formula (10), after the second compensation voltage $V_{AVC2}$ of the data voltage is compensated for, the emitting brightness L of the display module has nothing to do with the second resistance R2 and the voltage drop caused by the second resistance R2 is compensated for in the data signal output by the driver chip IC. The emitting brightness L of the display module is related to the first resistance R1 and the first resistance R1 is kept not to be compensated, so as to improve the effect of brightness increase and improve the peak brightness, obtaining an excellent local-picture display effect.

Exemplarily, the preset value may be, for example, the output voltage $PVDD_{power}$ of the power chip 60.

In the display module provided in the embodiment of the present disclosure, the voltage detection circuit 50 includes the first detection terminal 51, the second detection terminal 52, the output terminal 54 and the control terminal 53. The first detection terminal 51 is electrically connected to the power line 20, the second detection terminal 52 is electrically connected to the power bus 31, the output terminal 54 is electrically connected to the detection pin 41, and the control terminal 53 is electrically connected to the control pin 42. When the control terminal 53 controls the output terminal 54 to be electrically connected to the first detection terminal 51, the detection pin 41 of the driver chip IC acquires the voltage drop across the first resistance R1 and across the second resistance R2, and the voltage drop across the first resistance R1 and across the second resistance R2 is compensated for, so that the display module obtains an excellent full-picture display effect. When the control terminal 53 controls the output terminal 54 to be electrically connected to the second detection terminal 52, the detection pin 41 of the driver chip IC acquires the voltage drop across the second resistance R2, and the voltage drop across the second resistance R2 is compensated for, so that the display module obtains an excellent local-picture display effect.

Figure 3:
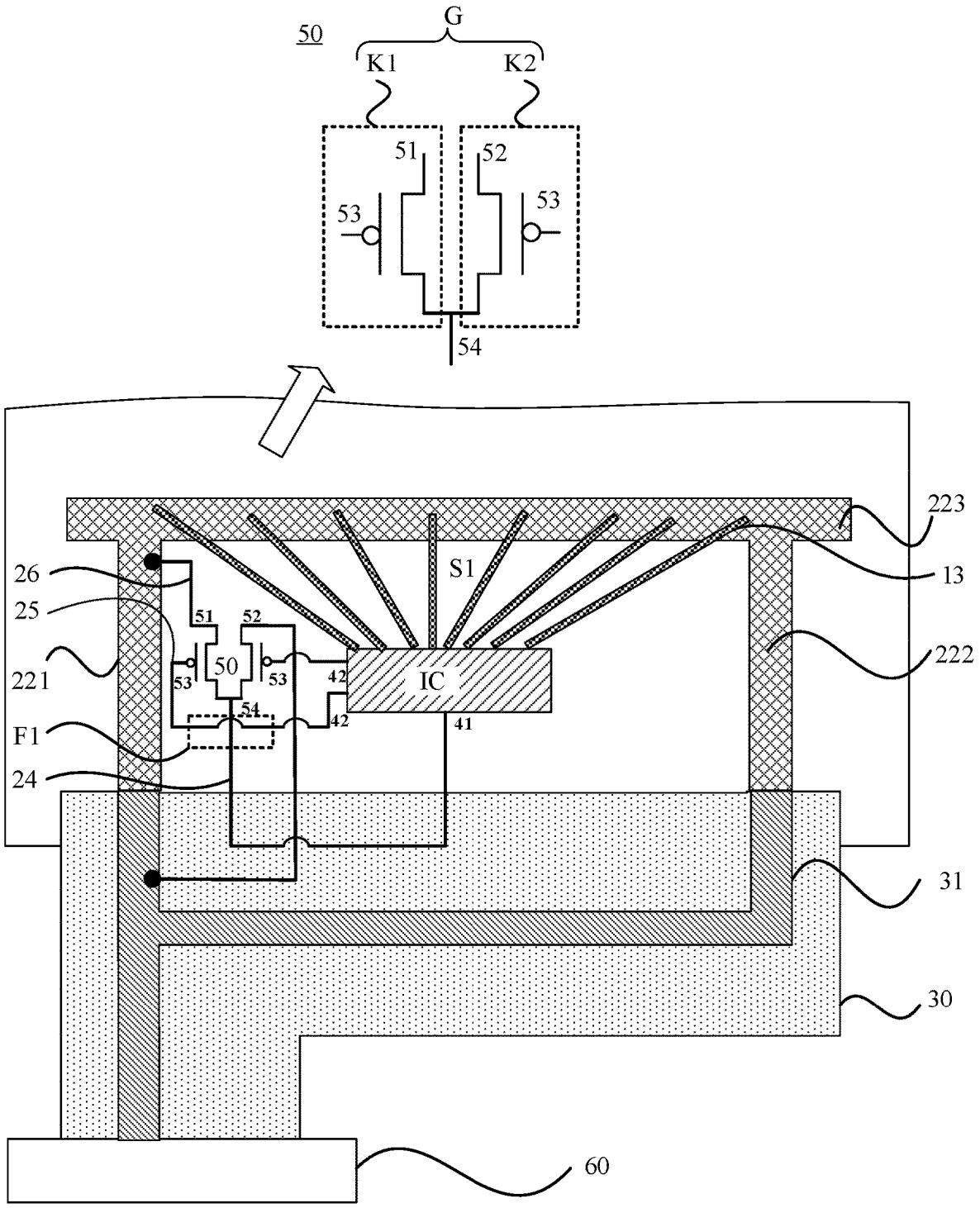
FIG. 3 is a top view of another display module according to an embodiment of the present disclosure.

FIG. 3 is a top view of another display module according to an embodiment of the present disclosure. In FIG. 3, the display area 101 and the structures within the display area 101 are omitted. Referring to FIG. 3, the voltage detection circuit 50 includes at least one switch unit group G, and one switch unit group G includes a first switch transistor K1 and a second switch transistor K2. The first detection terminal 51 is a first electrode of the first switch transistor K1. The second detection terminal 52 is a first electrode of the second switch transistor K2. The output terminal 54 of the voltage detection circuit 50 is a second electrode of the first switch transistor K1 and a second electrode of the second switch transistor K2 which are electrically connected to each other. Control terminals 53 are a control electrode of the first switch transistor K1 and a control electrode of the second switch transistor K2. That is, one control terminal 53 of the voltage detection circuit 50 is the control electrode of the first switch transistor K1, and the other control terminal 53 of the voltage detection circuit 50 is the control electrode of the second switch transistor K2. When a display picture requires a low voltage drop, the control terminal 53 of the driver chip IC controls the first switch transistor K1 to turn on and the second switch transistor K2 to turn off, so that the output terminal 54 of the voltage detection circuit 50 is electrically connected to the first detection terminal 51, and the driver chip IC detects the current voltage value of the power line 20. When a display picture requires a high peak brightness, the control terminal 53 of the driver chip IC controls the second switch transistor K2 to turn on and the first switch transistor K2 to turn off, so that the output terminal 54 of the voltage detection circuit 50 is electrically connected to the second detection terminal 52, and the driver chip IC detects the current voltage value of the power bus 31.

Figure 4:
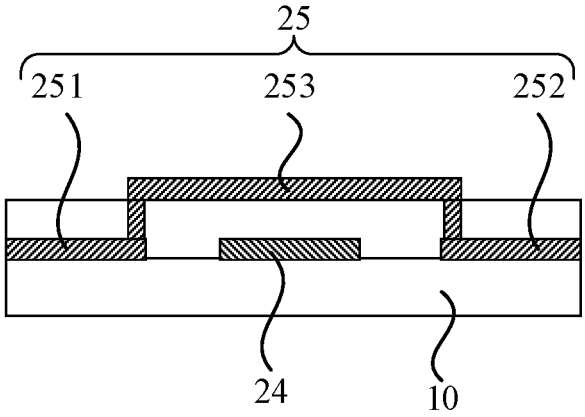
FIG. 4 is a cross sectional view of a region F1 in FIG. 3.

FIG. 4 is a cross sectional view of a region F1 of FIG. 3. Referring to FIG. 3 and FIG. 4, the display module further includes a control lead 25 and a test lead 24. A terminal of the control lead 25 is electrically connected to the control terminal 53 of the voltage detection circuit 50, and the other terminal of the control lead 25 is electrically connected to the control pin 42. A terminal of the test lead 24 is electrically connected to the output terminal 54 of the voltage detection circuit 50, and the other terminal of the test lead 24 is electrically connected to the detection pin 41. The control lead 25 includes a first lead segment 251, a second lead segment 252 and a first overpass bridge 253. The first lead segment 251, the second lead segment 252 and the test lead 24 are located at a same layer, the first overpass bridge 253 and the test lead 24 are insulated and overlapped at different layers, and the first lead segment 251 and the second lead segment 252 are electrically connected through the first overpass bridge 253. Therefore, short-circuit electrical connection between the control lead 25 and the test lead 24 is avoided at the intersection position of the control lead 25 and the test lead 24. In other embodiments, an overpass bridge may be made by using the test lead 24. That is, the test lead 24 includes a third lead segment, a fourth lead segment and a second overpass bridge. The third lead segment, the fourth lead segment and the control lead 25 are disposed at a same layer. The second overpass bridge and the control lead 25 are insulated and overlapped at different layers. The third lead segment and the fourth lead segment are electrically connected through the second overpass bridge.

Exemplarily, referring to FIG. 2 and FIG. 3, the display module may further include detection leads 26. A terminal of a detection lead 26 is electrically connected to the first detection terminal 51, and the other terminal of the detection lead 26 is electrically connected to the power line 20. A terminal of another detection lead 26 is electrically connected to the second detection terminal 51, and the other terminal of the another detection lead 26 is electrically connected to the power bus 31. Therefore, the detection lead 26 is used for electrically connecting the first detection terminal 51 or the second detection terminal 52 to a detection point. At the intersection position of the detection lead 26 and the test lead 24, an overpass bridge may be made by using one of the detection lead 26 or the test lead 24. At the intersection position of the detection lead 26 and the control lead 25, an overpass bridge may be made by using one of the detection lead 26 or the control lead 25.

In an embodiment, referring to FIG. 2 and FIG. 3, the test lead 24 is electrically connected to the output terminal 54 of the voltage detection circuit 50 after passing, from the detection pin 41, through the substrate 10, the flexible circuit board 30 and the substrate 10 in sequence. That is, the test lead 24 includes a first sub-segment disposed on the substrate 10 and a second sub-segment disposed on the flexible circuit board 30. When the driver chip IC is disposed on the substrate 10, many input lines (not shown in the figures, where the input lines of the driver chip IC are disposed on the side of the driver chip IC away from the display area 101) of the driver chip IC occur. If the test lead 24 is disposed on the substrate 10, the test lead 24 intersects the plurality of input lines of the driver chip IC, increasing the wiring difficulty. Therefore, in the embodiment of the present disclosure, a part of the test lead 24 is disposed on the flexible circuit board 30 such that the test lead 24 is prevented from intersecting the plurality of input lines of the driver chip IC, reducing the wiring difficulty.

In an embodiment, referring to FIG. 3 and FIG. 4, the first switch transistor K1 and the second switch transistor K2 are both MOS transistors. A MOS transistor, also known as a metal-oxide-semiconductor field-effect transistor, is divided into an N-channel MOS transistor and a P-channel MOS transistor. The P-channel MOS transistor is a P-type switch transistor and the N-channel MOS transistor is an N-type switch transistor. The first electrode of the MOS transistor may be a source or a drain, the second electrode of the MOS transistor may be a drain or a source, and the control electrode of the MOS transistor may be a gate. In the field of display techniques, the MOS transistor is often formed in a stacked manner, and is referred to as a thin-film transistor.

Figure 5:
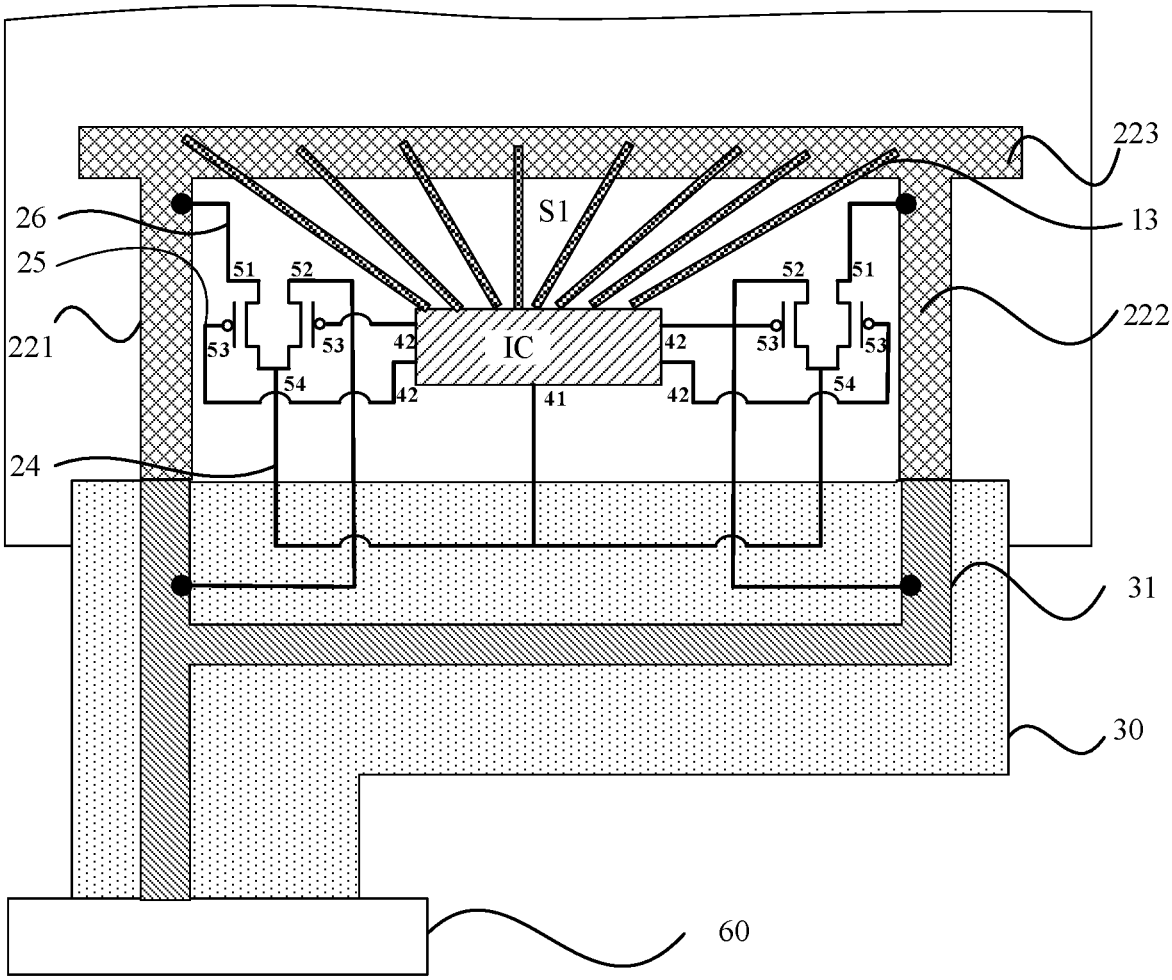
FIG. 5 is a top view of another display module according to an embodiment of the present disclosure.
Figure 6:
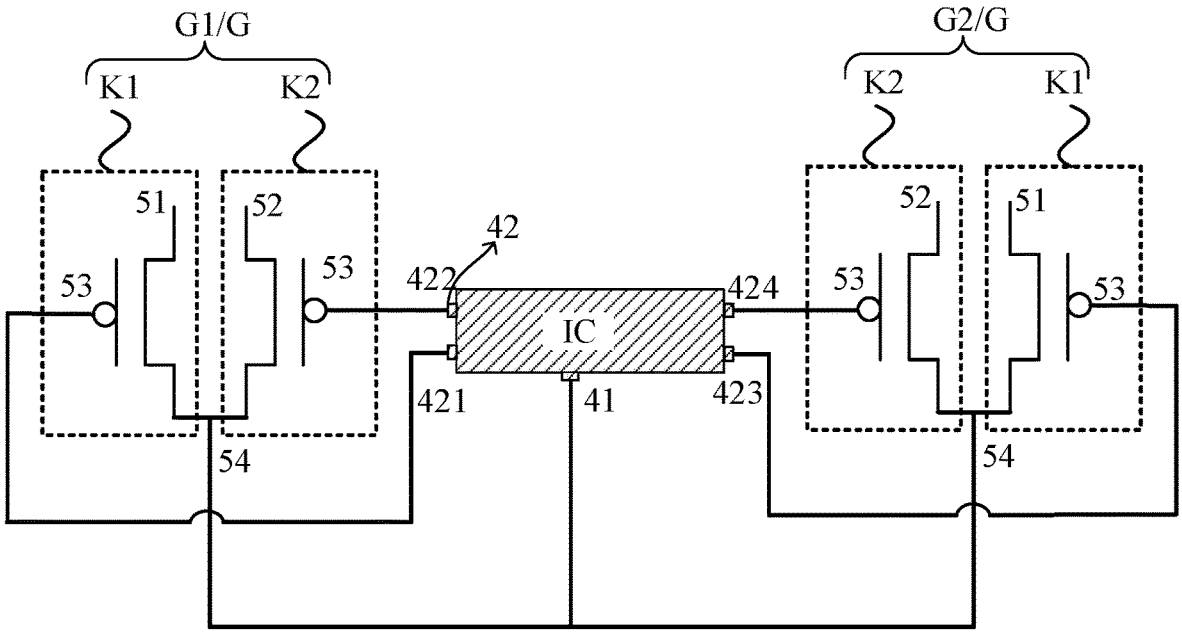
FIG. 6 is the schematic structure diagram of the voltage detection circuit of FIG. 5.

FIG. 5 is a top view of another display module according to an embodiment of the present disclosure. FIG. 6 is a schematic structure diagram of a voltage detection circuit of FIG. 5. Referring to FIG. 5 and FIG. 6, the voltage detection circuit 50 includes at least two switch unit groups G. Second electrodes of first switch transistors K1 in all switch unit groups G are electrically connected to a same detection pin 41, and second electrodes of second switch transistors K2 in all the switch unit groups G are also electrically connected to the same detection pin 41 since the second electrode of the first switch transistor K1 is electrically connected to the second electrode of the second switch transistor K2 in a same switch unit group G. In the embodiment of the present disclosure, the second electrodes of all first switch transistors K1 and the second electrodes of all second switch transistors K2 are electrically connected to the same detection pin 41, thereby reducing the number of detection pins 41. Further, the same detection pin 41 detects the voltage values of the output terminals 54 in the plurality of switch unit groups G such that the detected voltage is compromised and the difference in resistance at different detection point positions is taken into account. In other embodiments, a plurality of detection pins 41 may also be provided, and the output terminals 54 of at least two switch unit groups G are connected to different detection pins 41.

In an embodiment, referring to FIG. 5 and FIG. 6, the driver chip IC includes a plurality of control pins 42. The control electrode of each first switch transistor K1 is electrically connected to one control pin 42, the control electrode of each second switch transistor K2 is electrically connected to one control pin 42, and each control pin 42 is electrically connected to the control electrode of one first switch transistor K1 or the control electrode of one second switch transistor K2. That is, the control electrodes of any two first switch transistors K1 are electrically connected to two different control pins 42 respectively, the control electrodes of any two second switch transistors K2 are electrically connected to two different control pins 42 respectively, and any first switch transistor K1 and any second switch transistor K2 are electrically connected to two different control pins 42 respectively.

Exemplarily, referring to FIG. 5 and FIG. 6, the driver chip IC includes a first control pin 421, a second control pin 422, a third control pin 423, and a fourth control pin 424.

The voltage detection circuit 50 includes a first switch unit group G1 and a second switch unit group G2. The control electrode of the first switch transistor K1 in the first switch unit group G1 is electrically connected to the first control pin 421, the control electrode of the second switch transistor K2 in the first switch unit group G1 is electrically connected to the second control pin 422, the control electrode of the first switch transistor K1 in the second switch unit group G2 is electrically connected to the third control pin 423, and the control electrode of the second switch transistor K2 in the second switch unit group G2 is electrically connected to the fourth control pin 424.

Exemplarily, referring to FIG. 5 and FIG. 6, the first control pin 421 and the second control pin 422 are disposed on a first side of the driver chip IC, the third control pin 423 and the fourth control pin 424 are disposed on a second side of the driver chip IC, the first side of the driver chip IC is opposite to the second side of the driver chip IC, and the first side of the driver chip IC and the second side of the driver chip IC are each adjacent to a third side of the driver chip IC adjacent to the display area 101. In other embodiments, the first control pin 421, the second control pin 422, the third control pin 423, and the fourth control pin 424 may all be disposed on the third side of the driver chip IC adjacent to the display area 101.

In an embodiment, referring to FIG. 5 and FIG. 6, the voltage detection circuit 50 includes at least two switch unit groups G, the first electrodes of any two first switch transistors K1 are electrically connected to two different detection points on the power line 20 such that when the first switch transistors K1 are turned on and the second switch transistors K2 are turned off, the same detection pin 41 detects, through the first electrodes of the plurality of first switch transistors K1, the voltage value compromised at a plurality of different positions on the power line 20. The first electrodes of any two second switch transistors K2 are electrically connected to two different detection points on the power bus 31 such that when the second switch transistors K2 are turned on and the first switch transistors K1 are turned off, the same detection pin 41 detects, through the first electrodes of the plurality of second switch transistors K2, the voltage value compromised at a plurality of different positions on the power bus 31.

In an embodiment, referring to FIG. 2, FIG. 5 and FIG. 6, the power line 20 includes a first power connection line 221, a second power connection line 222 and a third power connection line 223 which are disposed in the non-display area 102, the first power connection line 221 and the second power connection line 222 are arranged at intervals in a first direction and extend in a second direction, and the first direction intersects the second direction. The terminal of the first power connection line 221 adjacent to the display area 101 is electrically connected to the terminal of the second power connection line 222 adjacent to the display area 101 through the third power connection line 223, the terminal of the first power connection line 221 away from the display area 101 and the terminal of the second power connection line 222 away from the display area 101 are each electrically connected to the power bus 31. In the first direction, the driver chip IC is disposed between the first power connection line 221 and the second power connection line 222. The first power connection line 221, the second power connection line 222, the third power connection line 223 and the power bus 31 jointly surround the driver chip IC. The voltage detection circuit 50 includes a first switch unit group G1 and a second switch unit group G2, the first electrode of the first switch transistor K1 in the first switch unit group G1 is electrically connected to the first power connection line 221, and the first electrode of the first switch transistor K1 in the second switch unit group G2 is electrically connected to the second power connection line 222. In the embodiment of the present disclosure, in the non-display area 102, the power line 20 includes the first power connection line 221 and the second power connection line 222 which extend in the second direction. Correspondingly, the voltage detection circuit 50 includes the first switch unit group G1 through which the voltage value of the first power connection line 221 is acquired and includes the second switch unit group G2 through which the voltage value of the second power connection line 222 is acquired.

Figure 7:
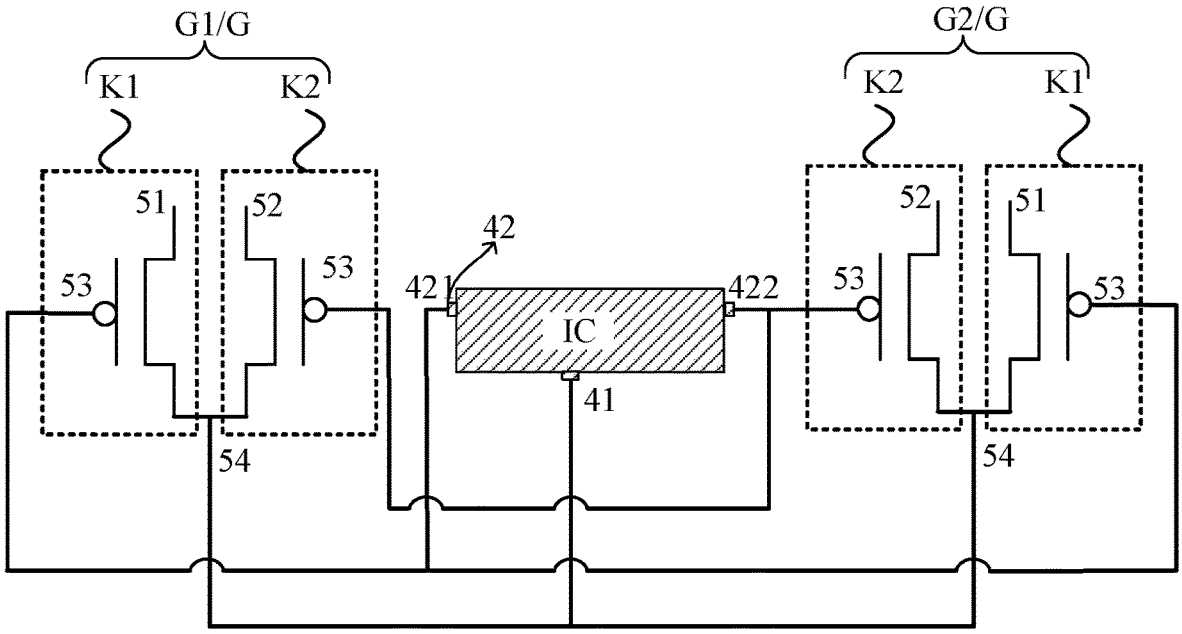
FIG. 7 is a schematic structure diagram of another voltage detection circuit according to an embodiment of the present disclosure.

FIG. 7 is a schematic structure diagram of another voltage detection circuit according to an embodiment of the present disclosure. In FIG. 7, merely the voltage detection circuit 50 and the driver chip IC are shown, and the display area 101, the structures within the display area 101, the flexible circuit board 30 and the like are omitted. Referring to FIG. 7, the voltage detection circuit 50 includes at least two switch unit groups G, the control electrodes of the first switch transistors K1 in all the switch unit groups G are electrically connected to each other, and the control electrodes of the second switch transistors K2 in all the switch unit groups G are electrically connected to each other. In the embodiment of the present disclosure, the control electrodes of the first switch transistors K1 in all the switch unit groups G are electrically connected to each other such that all the first switch transistors K1 can be controlled through a same control pin 42. The control electrodes of the second switch transistors K2 in all the switch unit groups G are electrically connected to each other such that all the second switch transistors K2 can be controlled through a same control pin 42. The number of control pins 42 is reduced.

Exemplarily, referring to FIG. 7, the driver chip IC includes the first control pin 421 and the second control pin 422. The control electrode of the first switch transistor K1 in the first switch unit group G1 and the control electrode of the first switch transistor K1 in the second switch unit group G2 are each electrically connected to the first control pin 421. The control electrode of the second switch transistor K2 in the first switch unit group G1 and the control electrode of the second switch transistor K2 in the second switch unit group G2 are each electrically connected to the second control pin 422.

Figure 8:
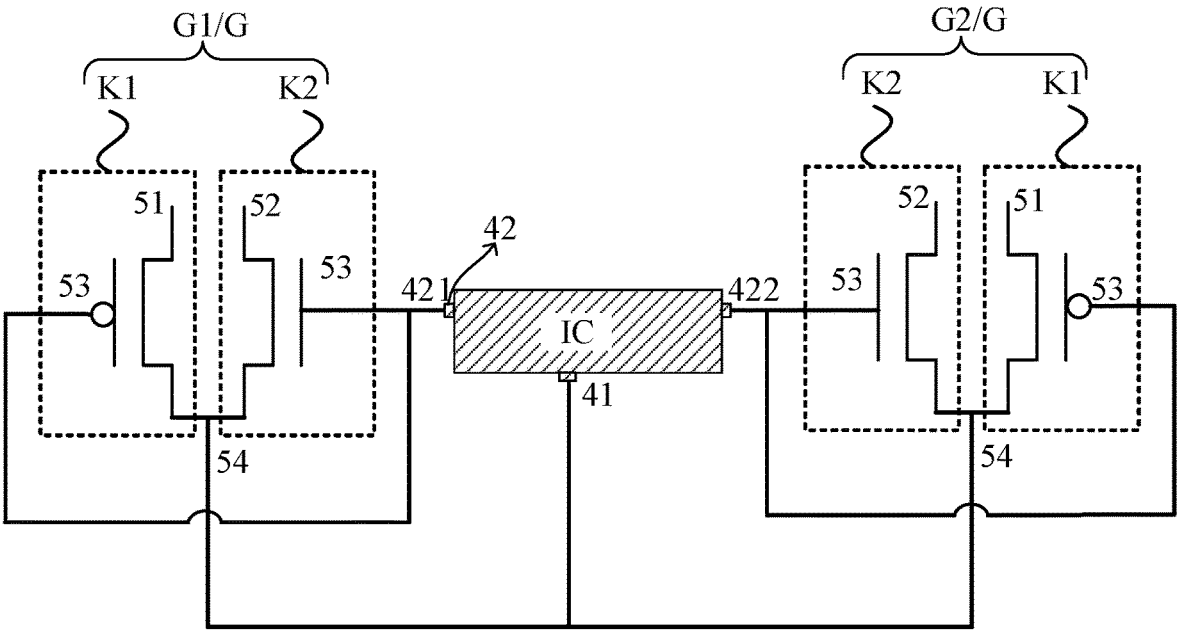
FIG. 8 is a schematic structure diagram of another voltage detection circuit according to an embodiment of the present disclosure.

FIG. 8 is a schematic structure diagram of another voltage detection circuit according to an embodiment of the present disclosure. Referring to FIG. 8, in a same switch unit group G, the first switch transistor K1 is a P-type switch transistor and the second switch transistor K2 is an N-type switch transistor. In the same switch unit group G, the control electrode of the first switch transistor K1 is electrically connected to the control electrode of the second switch transistor K2. In the embodiment of the present disclosure, one of the first switch transistor K1 or the second switch transistor K2 in the same switch unit group G is the P-type switch transistor, and the other is the N-type switch transistor. In the same switch unit group G, the control electrode of the first switch transistor K1 and the control electrode of the second switch transistor K2 are electrically connected to each other and are electrically connected to a same control pin 42. Under the same control signal, the second switch transistor K2 is turned off if the first switch transistor K1 is turned on and the second switch transistor K2 is turned on if the first switch transistor K is turned off, thereby simplifying the process of controlling the first switch transistor K1 and the second switch transistor K2 and reducing the number of control pins 42. In addition, the first switch transistor K1 and the second switch transistor K2 in the same switch unit group G may be disposed in the same space area. One of the first switch transistor K1 or the second switch transistor K2 in the same switch unit group G is provided as a P-type switch transistor and the other is provided as an N-type switch transistor, and the control electrode of the first switch transistor K1 is electrically connected to the control electrode of the second switch transistor K2. Therefore, the wiring difficulty of the control lead 25 can also be reduced. In other embodiments, in the same switch unit group G, the first switch transistor K1 may also be the N-type switch transistor and the second switch transistor K2 may also be the P-type switch transistor.

Exemplarily, referring to FIG. 8, the driver chip IC includes the first control pin 421 and the second control pin 422. The first switch transistor K1 is the P-type switch transistor, and the second switch transistor K2 is the N-type switch transistor. The control electrode of the first switch transistor K1 and the control electrode of the second switch transistor K2 in the first switch unit group G1 are both electrically connected to the first control pin 421. The control electrode of the first switch transistor K1 and the control electrode of the second switch transistor K2 in the second switch unit group G1 are both electrically connected to the second control pin 422.

Figure 9:
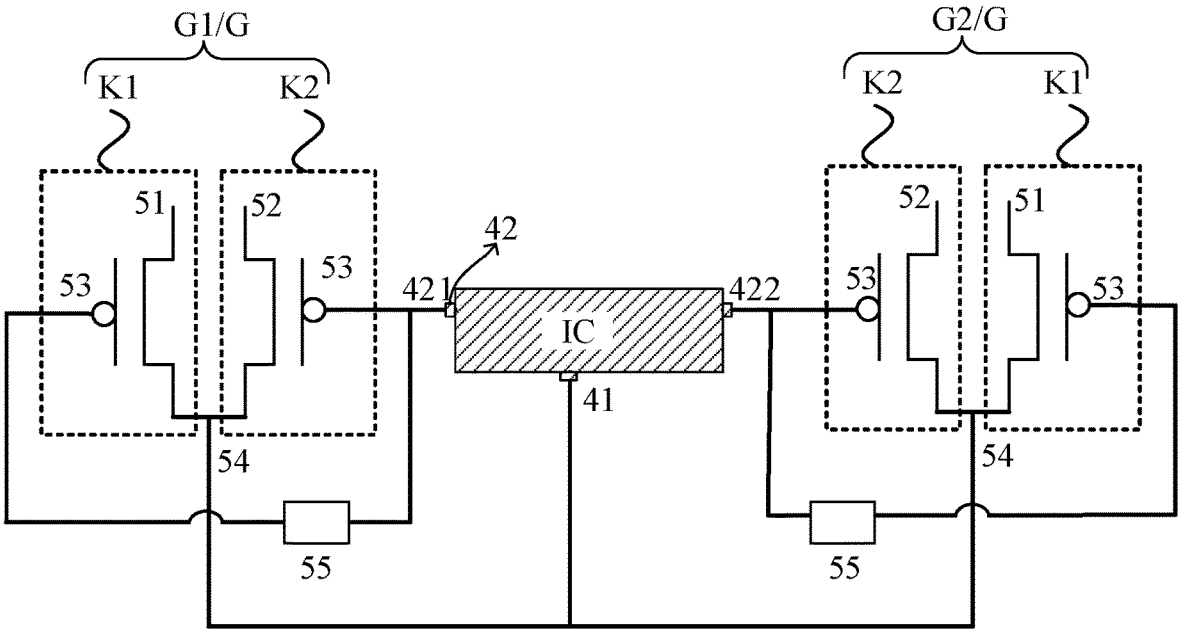
FIG. 9 is a schematic structure diagram of another voltage detection circuit according to an embodiment of the present disclosure.

FIG. 9 is a schematic structure diagram of another voltage detection circuit according to an embodiment of the present disclosure. Referring to FIG. 9, in a same switch unit group G, the first switch transistor K1 and the second switch transistor K2 are both P-type switch transistors. The voltage detection circuit 50 further includes an inverter 55 through which the control electrode of the first switch transistor K1 is connected to the control electrode of the second switch transistor K2. That is, the input terminal of the inverter 55 is electrically connected to the control electrode of the first switch transistor K1, the output terminal of the inverter 55 is electrically connected to a control pin 42, and the control electrode of the second switch transistor K2 in the same switch unit group G is electrically connected to the same control pin 42. In the embodiment of the present disclosure, under a same control signal, the second switch transistor K2 is turned off if the first switch transistor K1 is turned on and the second switch transistor K2 is turned on if the first switch transistor K1 is turned off, thereby simplifying the process of controlling the first switch transistor K1 and the second switch transistor K2 and reducing the number of control pins 42. In other embodiments, in the same switch unit group G, the first switch transistor K1 and the second switch transistor K2 may also both be N-type switch transistors, and the voltage detection circuit 50 further includes the inverter 55 through which the control electrode of the first switch transistor K1 is connected to the control electrode of the second switch transistor K2.

Exemplarily, referring to FIG. 9, the driver chip IC includes the first control pin 421 and the second control pin 422. The first switch transistor K1 and the second switch transistor K2 are both P-type switch transistors. In the first switch unit group G1, the control electrode of the first switch transistor K1 is electrically connected to the first control pin 421 through an inverter 55, and the control electrode of the second switch transistor K2 is directly electrically connected to the first control pin 421. In the second switch unit group G2, the control electrode of the first switch transistor K1 is electrically connected to the second control pin 422 through an inverter 55, and the control electrode of the second switch transistor K2 is directly electrically connected to the second control pin 422.

Figure 10:
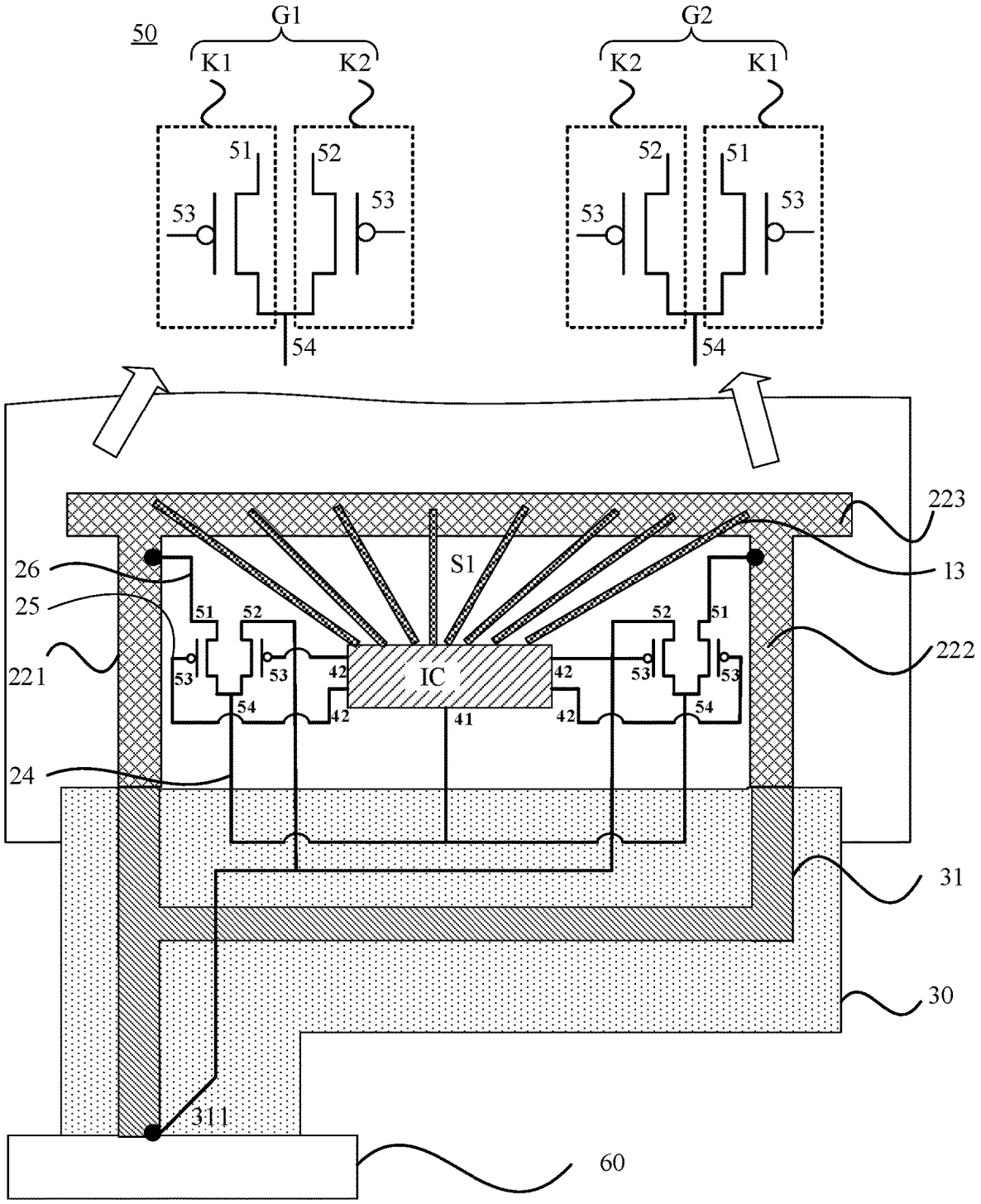
FIG. 10 is a top view of another display module according to an embodiment of the present disclosure.

FIG. 10 is a top view of another display module according to an embodiment of the present disclosure. Referring to FIG. 10, the power bus 31 includes a power bus input terminal 311 located at a terminal of the power bus 31 away from the power line 20. The power bus input terminal 311 is electrically connected to the power chip 60, and the power signal output by the power chip 60 is input to the power bus 31 from the power bus input terminal 311 and transmitted to the power line 20 via the power bus 31. The first electrode of the second switch transistor K2 in the first switch unit group G1 and the first electrode of the second switch transistor K2 in the second switch unit group G2 are each electrically connected to the power bus input terminal 311. In the embodiment of the present disclosure, the first electrode of the second switch transistor K2 in the first switch unit group G1 and the first electrode of the second switch transistor K2 in the second switch unit group G2 are each electrically connected to the power bus input terminal 311. Since the power bus input terminal 311 is a connection terminal between the power bus 31 and the power chip 60, the power bus input terminal 311 is the position on the power bus 31 closest to the power chip 60. When a display picture requires a high peak brightness, not only the first resistance R1 but also the resistance of the power bus 31 is not compensated, thus increasing the value of the resistance uncompensated, increasing the peak brightness and improving the local-picture display effect. On the other hand, the power bus 31 is electrically connected to the power chip 60 through the power bus input terminal 311, and a connection point exists at the position of the power bus input terminal 311. When the power bus input terminal 311 is connected to the first electrode of the second switch transistor K2, the connection point already existing at the position of the power bus input terminal 311 may be used without adding a new connection point.

Figure 11:
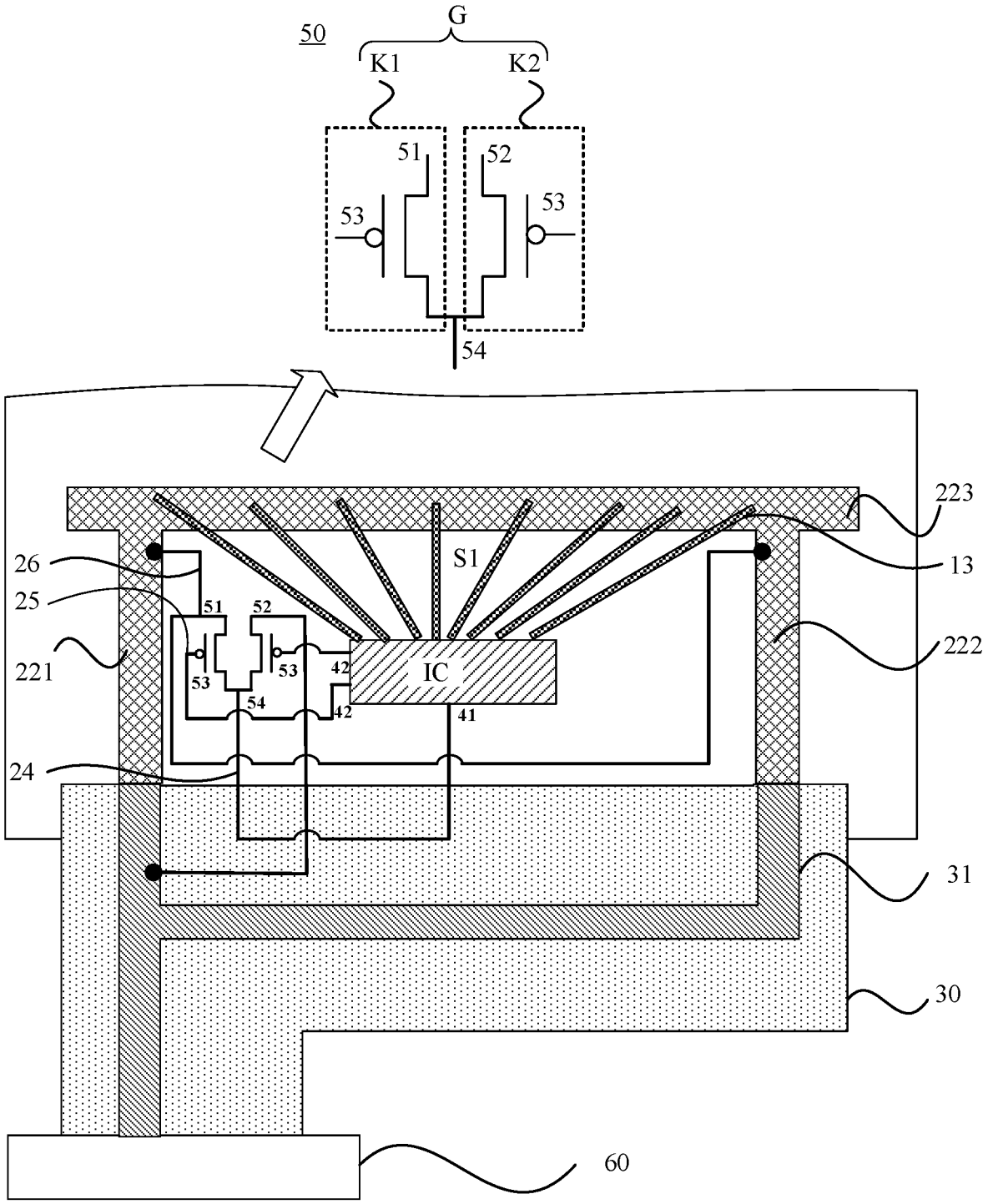
FIG. 11 is a top view of another display module according to an embodiment of the present disclosure.

FIG. 11 is a top view of another display module according to an embodiment of the present disclosure. Referring to FIG. 11, the first electrode of the first switch transistor K1 is electrically connected to at least two detection points on the power line 20. Therefore, when a display picture requires a low voltage drop, the first electrode of the first switch transistor K1 is electrically connected to the second electrode of the first switch transistor K1 and the detection pin 41 detects the voltage values of at least two detection points on the power line 20 such that the detected voltage is compromised and the difference in resistance at different detection point positions is taken into account. In other embodiments, the first electrode of the second switch transistor K2 may be configured to be electrically connected to at least two detection points on the power bus 31. Alternatively, the first electrode of the first switch transistor K1 is electrically connected to at least two detection points on the power line 20 and the first electrode of the second switch transistor K2 is electrically connected to at least two detection points on the power bus 31.

Exemplarily, referring to FIG. 11, the first electrode of the first switch transistor K1 is electrically connected to both the first power connection line 221 and the second power connection line 222, and the first electrode of the second switch transistor K2 is electrically connected to the power bus 31.

In an embodiment, with continued reference to FIG. 2, the display panel further includes a plurality of data lines 12 disposed in the display area 101 and a plurality of data connection lines 13 disposed in the non-display area 102, the plurality of data lines 12 are arranged in a first direction and extend in a second direction, the first direction intersects the second direction, and the plurality of data lines 12 are electrically connected to the driver chip IC through the plurality of data connection lines 13. The non-display area 102 includes a sector region S1, and the plurality of data connection lines 13 are disposed in the sector region S1. The voltage detection circuit 50 is disposed in a region outside the sector region S1 in the non-display area 102 and does not overlap the sector region S1. Since the sector region S1 needs to be provided with a large number of data connection lines 13, the voltage detection circuit 50 is disposed outside the sector region S1 such that the voltage detection circuit 50 does not occupy the space of the sector S1, thus not increasing the wiring difficulty of the data connection lines 13, and also avoiding overlapping of the test lead 24, the control lead 25, and the detection lead 26 with the data connection lines 13. In other embodiments, the voltage detection circuit 50 may also be disposed on the flexible circuit board 30. Alternatively, a part of the voltage detection circuit 50 is disposed in a region outside the sector region S1 in the non-display area 102, and the other part of the voltage detection circuit 50 is disposed on the flexible circuit board 30.

In an embodiment, with continued reference to FIG. 2, when the voltage detection circuit 50 is disposed in the region outside the sector region S1 in the non-display area 102, the driver chip IC is disposed in the non-display area 102. That is, both the voltage detection circuit 50 and the driver chip IC are disposed on the substrate 10 of the non-display area 102, thereby reducing the distance between the voltage detection circuit 50 and the driver chip IC and reducing the length of the control lead 25. In addition, when the driver chip IC is disposed on the flexible circuit board 30, the cost of the display module will be increased. In order to reduce the cost, the driver chip IC may be disposed on the substrate 10 in the non-display area 102.

Figure 12:
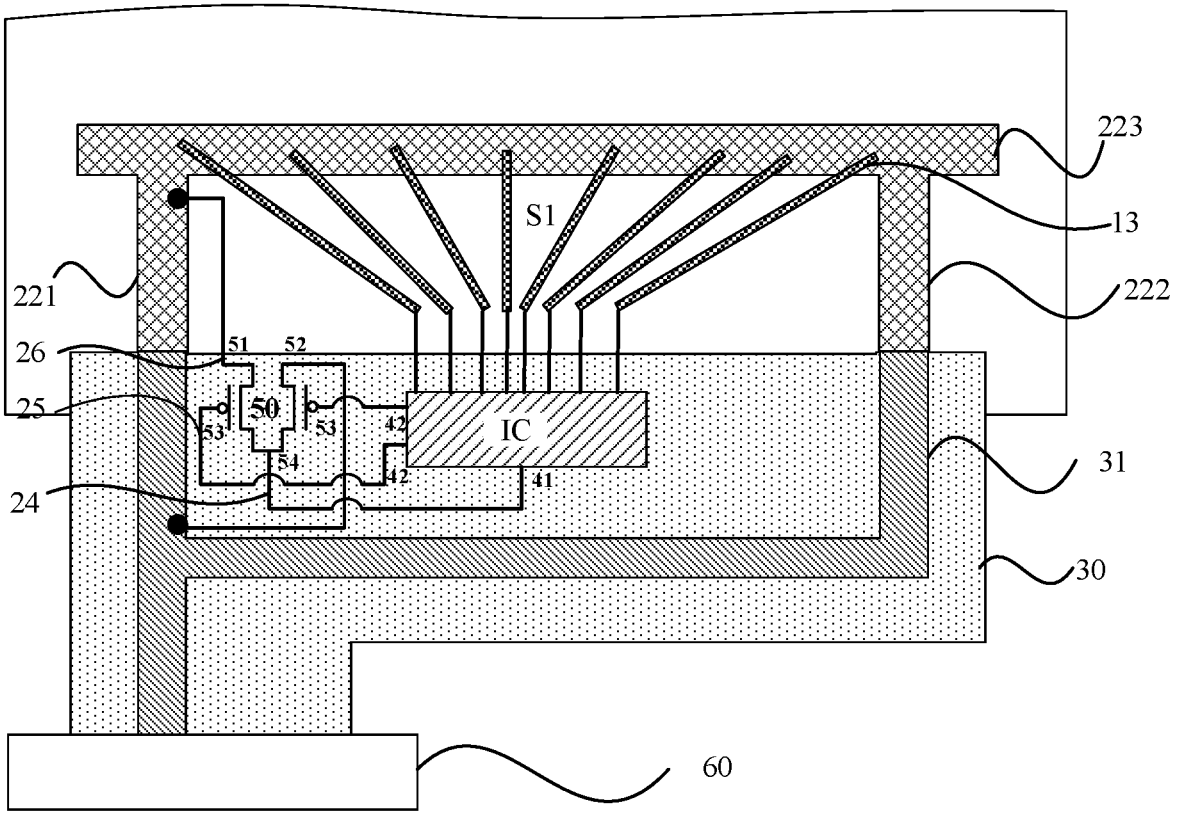
FIG. 12 is a top view of another display module according to an embodiment of the present disclosure.

FIG. 12 is a top view of another display module according to an embodiment of the present disclosure. Referring to FIG. 12, the voltage detection circuit 50 is disposed on the flexible circuit board 30. The flexible circuit board 30 is bound to the substrate 10 in the non-display area 102 such that the voltage detection circuit 50 is electrically connected to the power line 20 through a wire on the flexible circuit board 30.

In an embodiment, referring to FIG. 12, when the voltage detection circuit 50 is disposed on the flexible circuit board 30, the driver chip IC is disposed on the flexible circuit board 30. That is, both the voltage detection circuit 50 and the driver chip IC are disposed on the flexible circuit board 30, thereby reducing the distance between the voltage detection circuit 50 and the driver chip IC and reducing the length of the control lead 25. Both the control lead 25 and the test lead 24 may be formed by using wires on the flexible circuit board 30, thereby reducing the wiring difficulty. In addition, since both the voltage detection circuit 50 and the driver chip IC are disposed on the flexible circuit board 30, the space of the non-display area 102 is not occupied, and the narrow-bezel design of the display panel can be achieved.

Figure 13:
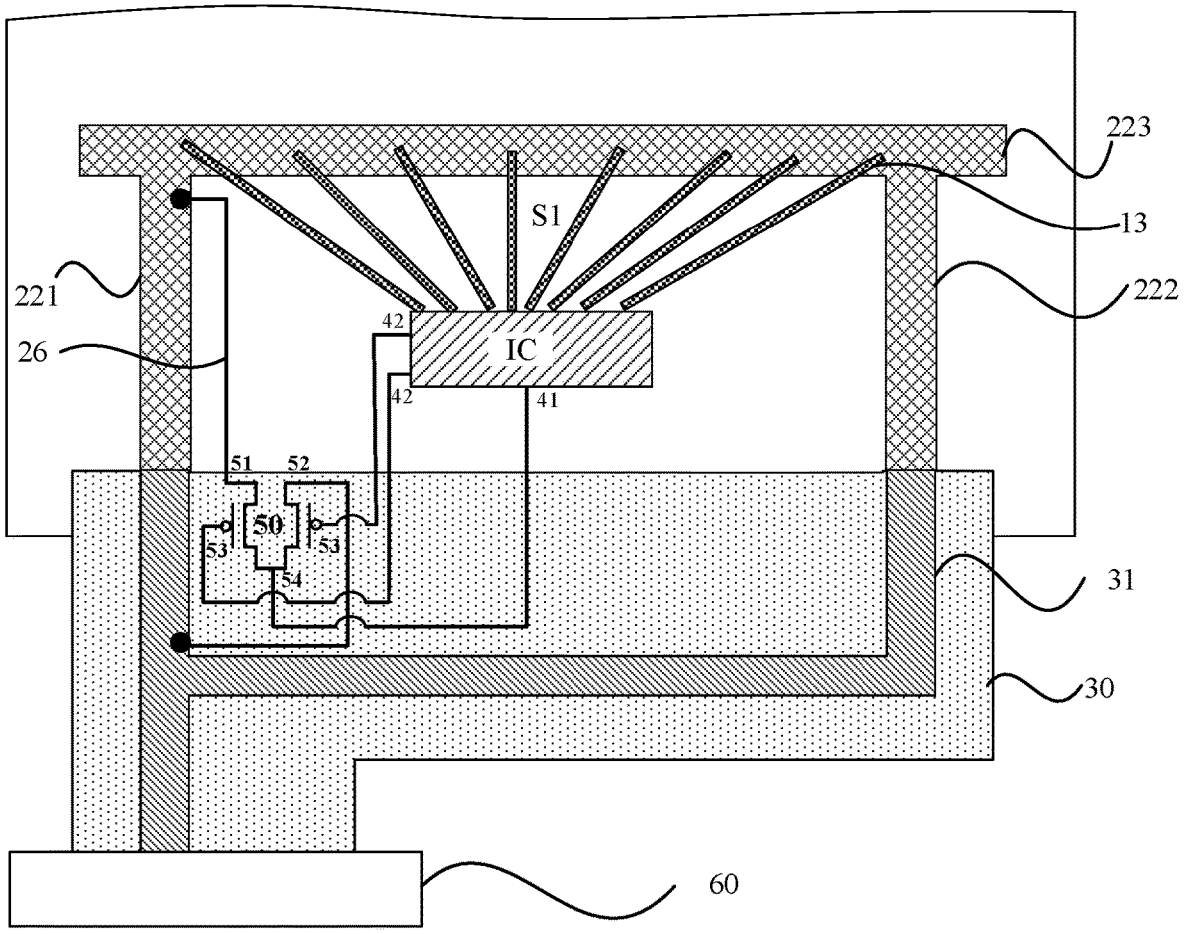
FIG. 13 is a top view of another display module according to an embodiment of the present disclosure.

FIG. 13 is a top view of another display module according to an embodiment of the present disclosure. Referring to FIG. 13, the driver chip IC is disposed in the non-display area 102, and the voltage detection circuit 50 is disposed on the flexible circuit board 30. When the driver chip IC is disposed on the flexible circuit board 30, the cost of the display module will be increased. In order to reduce the cost, the driver chip IC may be disposed on the substrate 10 in the non-display area 102. In addition, in order to reduce the space occupation of the non-display area 102 in the display panel and achieve a narrow bezel, the voltage detection circuit 50 may be disposed on the flexible circuit board 30. In other embodiments, the voltage detection circuit 50 may be disposed in a region outside the sector region S1 in the non-display area 102, and the driver chip IC may be disposed on the flexible circuit board 30.

Figure 14:
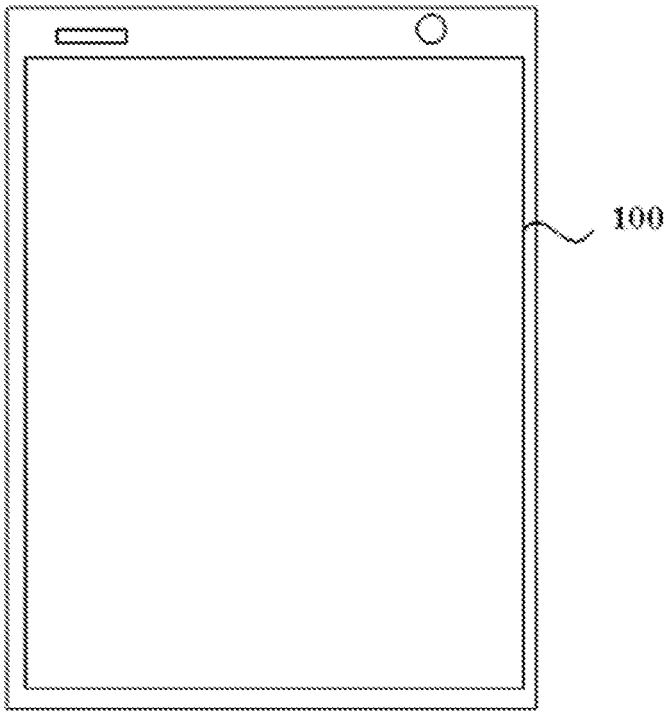
FIG. 14 is a schematic structure diagram of a display device according to an embodiment of the present disclosure.

A display device is further provided in an embodiment of the present disclosure. FIG. 14 is a schematic structure diagram of a display device according to an embodiment of the present disclosure. Referring to FIG. 14, the display device includes the display module 100 described in the embodiment described above. The display device may specifically be a mobile phone, a tablet computer, a smart wearable apparatus and so on.

Based on the same inventive concept, a driving method of the display module described above is further provided in an embodiment of the present disclosure. The driving method includes the steps described below.

When a display picture requires a low voltage drop, the driver chip controls turn-on to be performed between the output terminal 54 of the voltage detection circuit 50 and the first detection terminal 51 of the voltage detection circuit 50 so as to detect a current voltage value of the power line 20 and compensate for a difference, of a data voltage, between the current voltage value of the power line 20 and a preset value.

In this step, referring to formula (5), formula (6) and formula (7), after the difference, of the data voltage, between the current voltage value of the power line 20 and the preset value is compensated for, the voltage drop jointly caused by the first resistance R1 and the second resistance R2 is compensated for in the data signal output by the driver chip IC, thus satisfying the requirement of a low drop of the display picture and obtaining an excellent full-picture display effect.

When a display picture requires a high peak brightness, the driver chip controls turn-on to be performed between the output terminal 54 of the voltage detection circuit 50 and the second detection terminal 52 of the voltage detection circuit 50 so as to detect a current voltage value of the power bus 31 and compensate for a difference, of a data voltage, between the current voltage value of the power bus 31 and a preset value.

In this step, referring to formula (8), formula (9) and formula (10), after the difference, of the data voltage, between the current voltage value of the power bus 31 and the preset value is compensated for, the voltage drop caused by the second resistance R2 is compensated for in the data signal output by the driver chip IC, and the first resistance R1 is not compensated, so as to improve the effect of brightness increase and improve peak brightness, obtaining an excellent local-picture display effect.

It is to be noted that the above are merely some embodiments of the present disclosure and the technical principles used therein. It is to be understood by those skilled in the art that the present disclosure is not limited to the embodiments described herein. Those skilled in the art can make various apparent modifications, adaptations, combinations, and substitutions without departing from the scope of the present disclosure. Therefore, though the present disclosure has been described in detail through the embodiments described above, the present disclosure is not limited to the embodiments described above and may include other equivalent embodiments without departing from the concept of the present disclosure. The scope of the present disclosure is determined by the scope of the appended claims.

What is claimed is:

1. A display module, comprising:

a display panel, wherein the display panel comprises a display area and a non-display area, a substrate, a plurality of sub-pixels, and a power line, wherein the plurality of sub-pixels and the power line are disposed on the substrate;

a flexible circuit board, wherein the flexible circuit board is bound to the non-display area of the substrate and comprises a power bus electrically connected to the power line;

a driver chip comprising at least one detection pin and at least one control pin; and a voltage detection circuit comprising a first detection terminal, a second detection terminal, an output terminal and a control terminal, wherein the first detection terminal is electrically connected to the power line, the second detection terminal is electrically connected to the power bus, the output terminal is electrically connected to one of the at least one detection pin, and the control terminal is electrically connected to one of the at least one control pin, wherein the control terminal controls the output terminal to be electrically connected to the first detection terminal or to the second detection terminal.

2. The display module of claim 1, wherein the voltage detection circuit comprises at least one switch unit group, wherein each of the at least one switch unit group comprises a first switch transistor and a second switch transistor, wherein the first detection terminal is a first electrode of the first switch transistor, the second detection terminal is a first electrode of the second switch transistor, the output terminal is a second electrode of the first switch transistor and a second electrode of the second switch transistor, wherein the second electrode of the first switch transistor and the second electrode of the second switch transistor are electrically connected to each other, and wherein each of the control terminals is a control electrode of the first switch transistor and a control electrode of the second switch transistor respectively.

3. The display module of claim 1, wherein the voltage detection circuit comprises at least two switch unit groups, wherein each of the at least two switch unit groups comprises a first switch transistor and a second switch transistor, wherein second electrodes of first switch transistors in all of the at least two switch unit groups are electrically connected to a same one of the at least one detection pin.

4. The display module of claim 1, wherein the voltage detection circuit comprises at least two switch unit groups, wherein each of the at least two switch unit groups comprises a first switch transistor and a second switch transistor, wherein control electrodes of the first switch transistors in all of the at least two switch unit groups are electrically connected to each other, and control electrodes of the second switch transistors in the all of the at least two switch unit groups are electrically connected to each other.

5. The display module of claim 1, wherein the voltage detection circuit comprises at least two switch unit groups, wherein each of the at least two switch unit groups comprises a first switch transistor and a second switch transistor, wherein first electrodes of any two first switch transistors are electrically connected to two different detection points on the power line, and first electrodes of any two second switch transistors are electrically connected to two different detection points on the power bus.

6. The display module of claim 2, wherein in a same one of the at least one switch unit group, a first switch transistor is an N-type switch transistor and a second switch transistor is a P-type switch transistor; or a first switch transistor is a P-type switch transistor and a second switch transistor is an N-type switch transistor; and wherein in the same one of the at least one switch unit group, a control electrode of the first switch transistor is electrically connected to a control electrode of the second switch transistor.

7. The display module of claim 2, wherein in a same one of the at least one switch unit group, a first switch transistor and a second switch transistor are both N-type switch transistors or both P-type switch transistors; and wherein the voltage detection circuit further comprises an inverter through which a control electrode of the first switch transistor is connected to a control electrode of the second switch transistor.

8. The display module of claim 2, wherein the power line comprises a first power connection line, a second power connection line and a third power connection line, wherein the first power connection line, the second power connection line and the third power connection line are disposed in the non-display area, wherein the first power connection line and the second power connection line are arranged at intervals in a first direction and extend in a second direction, and the first direction intersects the second direction; wherein a terminal of the first power connection line adjacent to the display area is electrically connected to a terminal of the second power connection line adjacent to the display area through the third power connection line, wherein a terminal of the first power connection line away from the display area and a terminal of the second power connection line away from the display area each is electrically connected to the power bus; wherein in the first direction, wherein the driver chip is disposed between the first power connection line and the second power connection line; and wherein the voltage detection circuit comprises a first switch unit group and a second switch unit group, wherein a first electrode of a first switch transistor in the first switch unit group is electrically connected to the first power connection line, and wherein a first electrode of a first switch transistor in the second switch unit group is electrically connected to the second power connection line.

9. The display module of claim 8, wherein the power bus comprises a power bus input terminal located at a terminal of the power bus away from the power line; and wherein a first electrode of a second switch transistor in the first switch unit group and a first electrode of a second switch transistor in the second switch unit group each is electrically connected to the power bus input terminal.

10. The display module of claim 2, wherein the driver chip comprises a plurality of control pins; and wherein a control electrode of each first switch transistor is electrically connected to one of the plurality of control pins, a control electrode of each second switch transistor is electrically connected to one of the plurality of control pins, and each of the plurality of control pins is electrically connected to a control electrode of one first switch transistor or a control electrode of one second switch transistor.

11. The display module of claim 2, wherein the display module comprises at least one of the following connection modes: the first electrode of the first switch transistor is electrically connected to at least two detection points on the power line, or the first electrode of the second switch transistor is electrically connected to at least two detection points on the power bus.

12. The display module of claim 2, wherein the first switch transistor and the second switch transistor are both MOS transistors.

13. The display module of claim 1, further comprising a control lead and a test lead, wherein a terminal of the control lead is electrically connected to the control terminal of the voltage detection circuit, another terminal of the control lead is electrically connected to one of the at least one control pin, a terminal of the test lead is electrically connected to the output terminal of the voltage detection circuit, and another terminal of the test lead is electrically connected to the one of the at least one detection pin; and wherein the control lead comprises a first lead segment, a second lead segment and a first overpass bridge, wherein the first lead segment, the second lead segment and the test lead are located at a same layer, wherein the first overpass bridge and the test lead are insulated and overlapped at different layers, and wherein the first lead segment and the second lead segment are electrically connected through the first overpass bridge; or wherein the test lead comprises a third lead segment, a fourth lead segment and a second overpass bridge, wherein the third lead segment, the fourth lead segment and the control lead are located at a same layer, wherein the second overpass bridge and the control lead are insulated and overlapped at different layers, and wherein the third lead segment and the fourth lead segment are electrically connected through the second overpass bridge.

14. The display module of claim 13, wherein the test lead is electrically connected to the output terminal of the voltage detection circuit after passing in a sequence, from the one of the at least one detection pin, through the substrate, to the flexible circuit board.

15. The display module of claim 1, wherein the display panel further comprises a plurality of data lines disposed in the display area and a plurality of data connection lines disposed in the non-display area, wherein the plurality of data lines is arranged in a first direction and extend in a second direction, wherein the first direction intersects the second direction, and wherein the plurality of data lines is electrically connected to the driver chip through the plurality of data connection lines;

wherein the non-display area comprises a sector region, wherein the plurality of data connection lines is disposed in the sector region; and wherein the voltage detection circuit is disposed on at least one of the following regions: a region outside the sector region in the non-display area, or the flexible circuit board.

16. The display module of claim 15, wherein in a case where the voltage detection circuit is disposed in the region outside the sector region in the non-display area, the driver chip is disposed in the non-display area; and wherein in a case where the voltage detection circuit is disposed on the flexible circuit board, the driver chip is disposed on the flexible circuit board.

17. A display device, comprising a display module, wherein the display module comprises:

a display panel, wherein the display panel comprises a display area and a non-display area, a substrate, a plurality of sub-pixels, and a power line, wherein the plurality of sub-pixels and the power line are disposed on the substrate;

a flexible circuit board, wherein the flexible circuit board is bound to the substrate in the non-display area and comprises a power bus electrically connected to the power line;

a driver chip comprising at least one detection pin and at least one control pin; and a voltage detection circuit comprising a first detection terminal, a second detection terminal, an output terminal and a control terminal, wherein the first detection terminal is electrically connected to the power line, the second detection terminal is electrically connected to the power bus, the output terminal is electrically connected to one of the at least one detection pin, and the control terminal is electrically connected to one of the at least one control pin, wherein the control terminal controls the output terminal to be electrically connected to the first detection terminal or to the second detection terminal.

18. A driving method of a display module, wherein the display module comprises:

a display panel, wherein the display panel comprises a display area and a non-display area, a substrate, and a plurality of sub-pixels and a power line, wherein the plurality of sub-pixels and the power line are disposed on the substrate;

a flexible circuit board, wherein the flexible circuit board is bound to the substrate in the non-display area and comprises a power bus electrically connected to the power line;

a driver chip comprising at least one detection pin and at least one control pin; and a voltage detection circuit comprising a first detection terminal, a second detection terminal, an output terminal and a control terminal, wherein the first detection terminal is electrically connected to the power line, the second detection terminal is electrically connected to the power bus, the output terminal is electrically connected to one of the at least one detection pin, and the control terminal is electrically connected to one of the at least one control pin, wherein the control terminal controls the output terminal to be electrically connected to the first detection terminal or to the second detection terminal, wherein the driving method comprises:

wherein in a case where a display picture requires a low voltage drop, controlling, by the driver chip, turn-on to be performed between the output terminal of the voltage detection circuit and the first detection terminal of the voltage detection circuit so as to detect a current voltage value of the power line and compensate for a difference, of a data voltage output by the driver chip, between the current voltage value of the power line and a preset value; and wherein in a case where a display picture requires a high peak brightness, controlling, by the driver chip, turn-on to be performed between the output terminal of the voltage detection circuit and the second detection terminal of the voltage detection circuit so as to detect a current voltage value of the power bus and compensate for a difference, of a data voltage output by the driver chip, between the current voltage value of the power bus and a preset value.

* * * * *